US008622433B2

(12) United States Patent
Depta et al.

(10) Patent No.: US 8,622,433 B2
(45) Date of Patent: Jan. 7, 2014

(54) SECURITY DOCUMENT

(75) Inventors: Georg Depta, Rosenheim (DE); Karlheinz Mayer, Augsburg (DE); Christof Baldus, München (DE); Peter Franz, Pienzenau/Bruck (DE); Max Voit, Weilheim (DE); Walter Dörfler, München (DE)

(73) Assignee: Giesecke & Devrient GmbH, Munich (DE)

( * ) Notice: Subject to any disclaimer, the term of this patent is extended or adjusted under 35 U.S.C. 154(b) by 751 days.

(21) Appl. No.: 11/579,495

(22) PCT Filed: May 2, 2005

(86) PCT No.: PCT/EP2005/004741

§ 371 (c)(1),
(2), (4) Date: Nov. 1, 2007

(87) PCT Pub. No.: WO2005/108109

PCT Pub. Date: Nov. 17, 2005

(65) Prior Publication Data

US 2008/0191462 A1 Aug. 14, 2008

(30) Foreign Application Priority Data

May 5, 2004 (DE) ..... 10 2004 022 081
Jun. 4, 2004 (DE) ..... 10 2004 027 306

(51) Int. Cl.
*B42D 15/00* (2006.01)

(52) U.S. Cl.
USPC ..... 283/72; 283/86

(58) Field of Classification Search
USPC ..... 283/72, 85, 86, 92, 94
See application file for complete search history.

(56) References Cited

U.S. PATENT DOCUMENTS

| | | | | |
|---|---|---|---|---|
| 4,234,214 | A | 11/1980 | Lee | |
| 4,894,110 | A * | 1/1990 | Lass et al. | 283/94 |
| 5,005,872 | A | 4/1991 | Lass et al. | |
| 6,082,778 | A * | 7/2000 | Solmsdorf | 283/85 |
| 6,139,065 | A | 10/2000 | Washburn et al. | |
| 6,306,493 | B1 | 10/2001 | Brownfield | |
| 2002/0122931 | A1 * | 9/2002 | Brownfield et al. | 428/324 |
| 2003/0136847 | A1 * | 7/2003 | Braun | 283/74 |
| 2003/0161017 | A1 * | 8/2003 | Hudson et al. | 359/2 |

(Continued)

FOREIGN PATENT DOCUMENTS

| | | |
|---|---|---|
| DE | 28 36 529 | 3/1979 |
| DE | 197 32 860 | 2/1999 |

(Continued)

OTHER PUBLICATIONS

Dictionary.com; Related Words for "inscribed".*

(Continued)

*Primary Examiner* — Kyle Grabowski
(74) *Attorney, Agent, or Firm* — Bacon & Thomas, PLLC

(57) ABSTRACT

The invention relates to a value document, such as bank note, passport or the like, which has a security paper and a marking produced with the help of a laser, the security paper having at least one partial area with a coating, and the marking extending over the border area between coating and security paper. Further, the invention relates to a security paper and methods for producing an inventive value document and security paper.

17 Claims, 3 Drawing Sheets

(56) References Cited

U.S. PATENT DOCUMENTS

| | | | |
|---|---|---|---|
| 2004/0232691 | A1 | 11/2004 | Lazzerini |
| 2006/0145468 | A1 | 7/2006 | Plaschka et al. |

FOREIGN PATENT DOCUMENTS

| | | |
|---|---|---|
| DE | 198 22 605 | 11/1999 |
| EP | 0 918 649 | 6/1999 |
| GB | 1 580 553 | 12/1980 |
| WO | WO 03/023723 | 3/2003 |
| WO | WO 2004/009371 | 1/2004 |

OTHER PUBLICATIONS

International Search Report dated Aug. 1, 2005 in PCT/EP2005/004741.

* cited by examiner

SECURITY DOCUMENT

This invention relates to a value document, such as bank note, identity card, passport or the like, which has a security paper and a marking produced with the help of a laser, the security paper having at least one partial area with a coating. Furthermore, the invention relates to a security paper and methods for producing an inventive value document and security paper.

Bank notes, checks, travel tickets, admission tickets and other value documents, in particular made of paper, are equipped for the purposes of falsification security with security features by which the authenticity of the value documents can be checked.

In this connection it has been proposed to apply markings to a document by means of laser radiation to obtain an irreversible and visually readily detectable change in the document. For example, it is proposed in DE 28 36 529 C2 to burn the serial number out of a printing ink layer by means of a suitably controlled laser beam. In EP 0 918 649 B1 it is proposed to repeat the identification number by locally reducing the document thickness by means of laser etching at another place on the document. In both above-mentioned cases, material is thus removed by means of laser radiation.

In contrast, other approaches provide for only blackening the substrate material by means of laser radiation. To obtain particularly readily legible and sharp-edged markings, it is also known to admix absorbents and carbon forming agents, for example microground plastics, to the paper (DE 197 32 860 A1).

DE 198 22 605 A1 takes a different path. It is proposed therein to first treat the paper substrate surface with laser energy to change the surface structurally, and then provide said surface with an opaque coating, for example by printing, lacquering and/or metallizing. Previously changing the surface leads to a recognizable change in color density, color location, luster and/or reflection in the subsequently applied coating, thereby creating a visible security feature.

The problem of the present invention is to propose a value document and a security paper with an improved visual security feature which has high falsification security, as well as a method for producing such a security feature.

An inventive value document, such as a bank note, a passport or the like, has a security paper and a marking produced with the help of a laser, the security paper being provided with a coating at least in one partial area, and the marking extending over the border area between coating and security paper. Since the laser is guided over the value document continuously in the form of the marking, and the laser radiation influences the coating and the paper substrate differently, the marking shows a different appearance in the various areas, these different appearances running directly into each other. The marking thus appears with perfect registration at the transition in the border area between coating and security paper, causing the falsification security against reproduction obtained with said marking to be very high.

According to a preferred embodiment, the coating has at least one metal layer, such as aluminum, gold, silver, etc. The action of the laser radiation removes the metal layer, so that the part of the marking located within the metal layer is present in the form of gaps in the metal layer. Since the laser beam is guided continuously over the border area between coating and security paper, the negative representation of the marking runs seamlessly into a positive representation in the area of the security paper.

This is because the laser action leads to a color change or color alteration of the security paper in the marked area. The type and shade of the color alteration depends on the composition of the security paper used. Said color change or color alteration can be increased by suitable additives which can be contained within the volume of the security paper, the sizing or a subsequent priming. The type of additives used is dependent on the type of laser used or the laser wavelength used. Additives absorbing laser radiation can be used, such as carbon black, thermochromic substances or titanium dioxide.

The part of the inventive marking located within the security paper can also be of tactilely perceptible design, as described in WO 204/009371.

The inventive metal layer can be a printed layer containing metal pigments or metallic effect pigments or a vapor-deposited or sputtered layer.

In the latter case the metal layer is preferably prepared on a separate carrier and applied to the security paper or value document in the form of a label or transfer element. Such labels or transfer elements can also have any further layers, such as a lacquer layer in which diffraction structures are embossed in the form of a relief. The metal layer normally serves as a reflecting layer for the diffraction structures.

According to a further embodiment, the coating can be formed as a laser-sensitive recording layer, whereby it has at least one component absorbent to laser radiation of a selected wavelength. A suitable laser-sensitive recording layer is for example an ink mixture having one mixture component absorbent to laser radiation and one mixture component transparent to laser radiation. The marking is visually recognizable here due to an irreversible change in the optical properties of the ink mixture caused by the action of the laser radiation. The absorbent mixture component can be for example bleached, vaporized, changed in its reflection properties or converted by a chemical reaction into a material with different optical properties under the action of the laser radiation.

Preferably, the ink mixture contains optically variable coloring pigments, whereby in particular optically variable liquid crystal pigments can be used for the mixture component transparent to laser radiation, and for example optically variable interference layer pigments for the absorbent mixture component.

Such a coating shows an interplay of colors upon a change of viewing angle, whereby the perceptible color effect is a superposition of the color effects of the various optically variable coloring pigments. The laser action causes the color effect of the interference layer pigments to disappear or change, so that the lasered areas contrast in color with the surroundings. However, the lasered areas still show an optically variable effect. If the lasered marking extends over the border area between coating and security paper, the optically variable portion of the marking is carried over into a non-optically variable portion which arises from lasering of the paper substrate. This creates the impression that the marking was produced by different methods in exact register.

A very similar appearance of the marking can be produced if the laser radiation transparent and absorbent portions of the mixture are disposed one above the other in separate layers.

For producing the marking it is preferable to use Nd:YAG lasers with a wavelength of 1064 nm. Depending on the type of marking to be produced, the laser can be used in continuous-wave mode or in pulsed mode. For example, in pulsed mode it is possible to produce a visible variation in the degree of blackening over the course of the marking in the security paper.

The laser marking can be used to represent alphanumeric characters, for example serial numbers of the value documents or any codes, such as one-dimensional or two-dimensional bar codes or blind codes, any symbols, graphics, patterns, pictures or microwriting. Any desired alphanumeric characters, such as date, time, batch number, or letterings are also possible. Every inventive marking extends beyond the border of the coating into the security paper, causing the appearance of the marking to change with perfect registration at the transition.

The inventive value document can have further security features, such as a security thread, an optically variable security element, a security print, such as an intaglio print, or machine readable security features, such as luminescent or magnetic substances. If the value document has a security thread, the inventive laser marking can also be provided in the area of the security thread. The inventive value documents can also be used for protecting products of any type.

The inventive value document is any document whose essential component is a security paper, such as a bank note, check, visa, label, passport page or another document to be protected made of security paper.

The step of laser inscription is done in any stage of production of the value document. It can thus be expedient to already provide a corresponding marking on the security paper after production in roll form. This is in particular the case when the security paper is provided in endless form with a foil coating, such as a diffractively effective, for example stripe-shaped security element, and said security element is to be provided with an inventive marking, as described above.

However, the step of laser marking is preferably done as one of the last working steps in the production of the value document. If the value documents are printed for example in the form of multiple-copy sheets, laser marking can be done on the sheet or already on the cut, finished value document. The latter is expedient in particular when the laser marking is to produce individual information, such as a serial number.

A special security-related advantage of the present invention is to be seen in that the described effect cannot be imitated by simple means. The use of lasers requires high investments and profound technical know-how far exceeding the state of knowledge required for using customary printing machines or digital printing devices.

A further advantage of the invention is that the laser marking can be carried out contactlessly at a speed typical of printing plants. In particular, each document can be marked individually by for example integrating the serial number or another individualizing feature into the value document as a security feature.

The advantages of the invention will be explained with reference to the following examples and supplementary figures. The described individual features and embodiments described hereinafter are inventive taken per se, but also in combination. The examples constitute preferred embodiments, but the invention is in no way limited thereto. The proportions shown in the figures do not correspond to the relations existing in reality and serve mainly to improve clearness.

Figure 1:
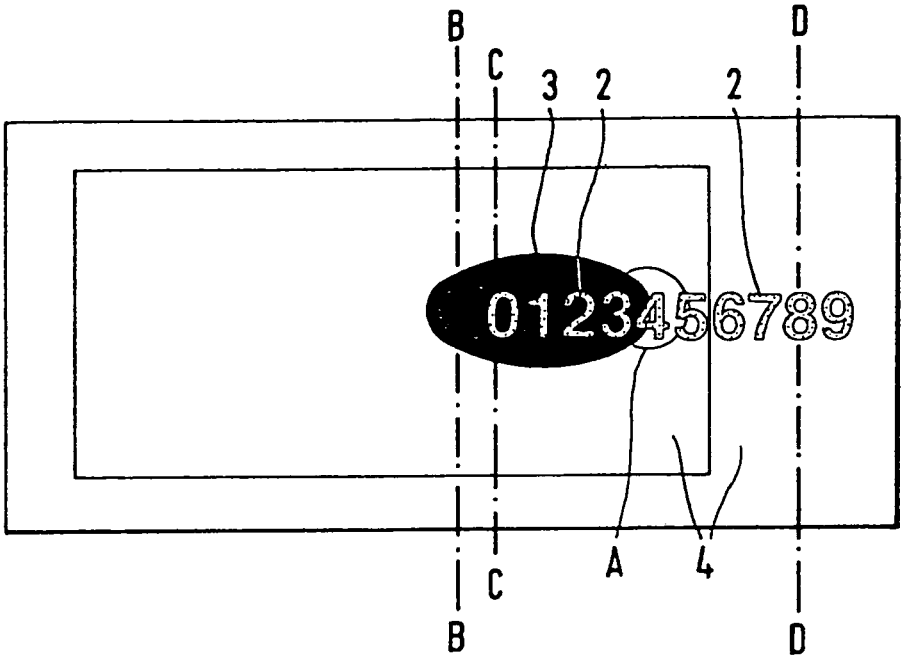
FIG. 1 shows an inventive value document.

FIG. 1 shows an inventive value document 1 in the form of a bank note. The value document 1 has according to the invention a marking 2 in the form of a numeric string which was produced by the action of a laser beam and extends into the edge area of the bank note 1.

Figure 2:
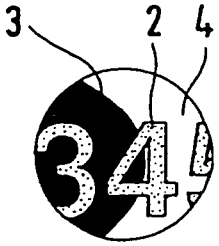
FIG. 2 shows a detail enlargement of the area A.

FIG. 2 shows a detail enlargement of the area A of FIG. 1. This enlargement clearly indicates the inventively essential transition of the marking 2 over the border area between coating 3 and security paper 4 within the shown "4". At the border of the two areas (3, 4) the marking 2 runs on seamlessly and without offset. Due to the darker gray level of the marking in the area of the security paper 4, the transition is clearly visible and appears with perfect registration, which would not be attainable as such for a printed marking.

Figure 3:
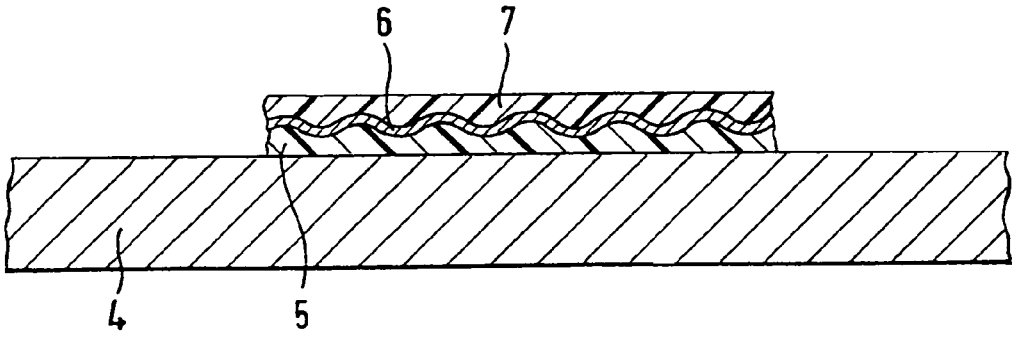
FIG. 3 shows a section through the inventive value document along the line B-B.

FIG. 3 shows a section through the value document 1 along the line B-B. In this case a coating 3 in the form of a security element is disposed in the area of the marking 2, the security element consisting of a transfer element. The transfer element is fastened to the value document 1 by means of an adhesive layer 5. A metal layer 6 is located between the adhesive layer 5 and a plastic layer 7, in particular lacquer layer 7.

Figure 4:
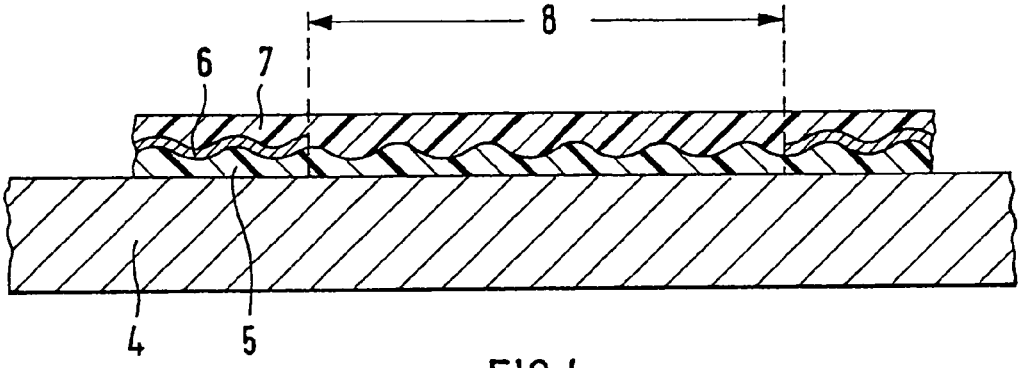
FIG. 4 shows a section through the inventive value document along the line C-C.

FIG. 4 shows a section through the value document 1 along the line C-C. It can be seen here that said metal layer 6 is lacking in the area of the marking 2. During the inscription or marking process with the laser the metal layer 6 is changed such that it is no longer visible. The reference number 8 designates the area exposed to laser radiation.

Figure 5:
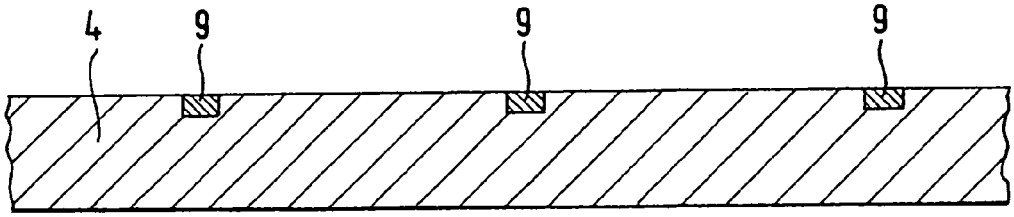
FIG. 5 shows a section through the inventive value document along the line D-D.

FIG. 5 shows a section through the value document 1 along the line D-D. A color alteration 9 caused by the laser inscription can be seen in the security paper (substrate) 4, which is part of the "8" belonging to the marking and recognizable in a top view. In this example an "8" is shown with a degree of blackening corresponding to a dark gray level. The laser power must be adjusted to the desired degree of blackening.

In the border area A the appearance or the representation mode of the marking 2 therefore changes. In the area of the coating 3 the marking 2 is shown in the form of gaps 8 in the metal layer 6, i.e. as a negative representation, while the marking 2 is present outside the coating 3 in the form of color alterations, i.e. as a positive representation.

Figure 6:
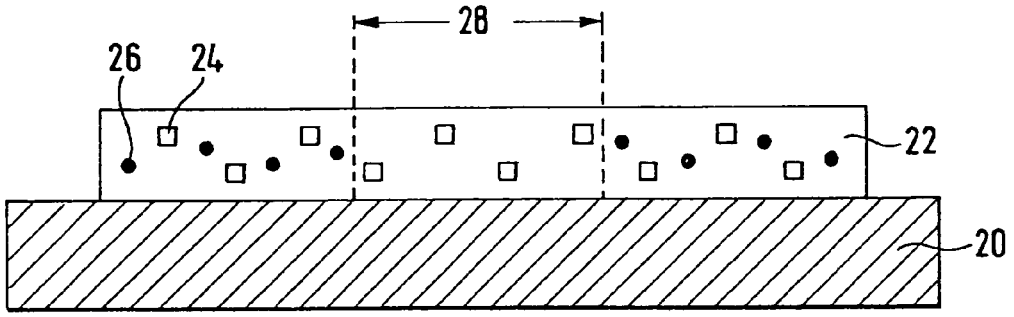
FIG. 6 shows an alternative structure of the coating.

FIG. 6 shows a security paper (substrate) 20, for example a bank note or another value document, having applied thereto a coating 22 comprising an ink mixture of two mixture components 24 and 26. One of the mixture components 24 is transparent to the radiation of the infrared laser subsequently used for marking, the other mixture component 26 absorbs the laser radiation. In the area 28 the marking layer 22 was irradiated with the marking laser with suitably selected laser parameters in order to remove, change or deactivate the absorbent mixture component 26 by the action of the laser radiation.

Depending on the material used, the absorbent mixture component 26 can be for example bleached, vaporized, changed in its reflection properties or converted by a chemical reaction into a material with different optical properties. Altogether, the irradiation irreversibly changes the optical properties of the ink mixture in the area 28. Possible effects include color alteration, production of a color change, brightening of a color, changing of the tilt color of a special-effect ink mixture or local changing of the polarization properties or the luminescence properties of the coating 22.

The laser-induced change in the optical properties of the ink mixture causes visually recognizable markings in the value document. These can be constituted by the form of the irradiated and modified areas 28 of the marking layer itself, or result only in interaction with further printed layers structured for example to contain information.

For example, an information-carrying printed layer can be provided between the substrate 20 and the coating 22, and the change in optical properties of the coating 22 consist in the production of transparent partial areas 28 in an otherwise opaque layer, so that the information of the printed layer is visible in said partial areas after laser irradiation.

Figure 7:
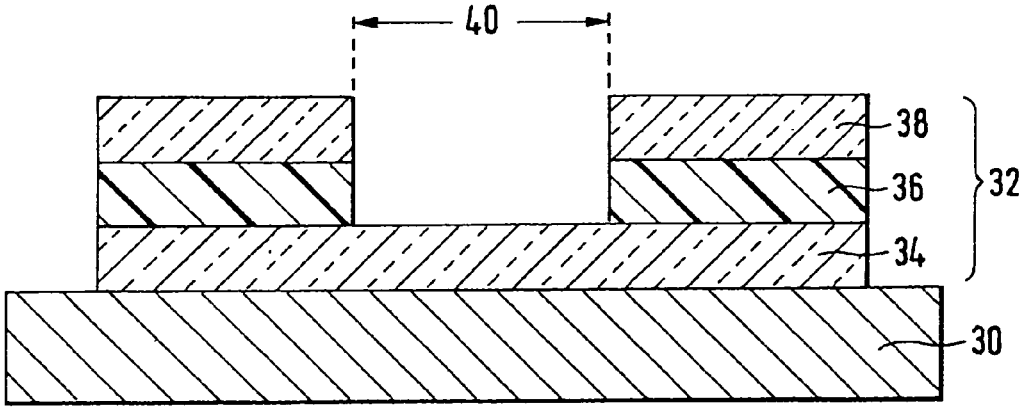
FIG. 7 shows another exemplary coating.

Another exemplary coating is shown in FIG. 7. A substrate 30 has applied thereto a coating 32 which has a first layer 34 transparent to laser radiation of the selected wavelength, an absorbent layer 36, and a second layer 38 transparent to laser radiation. At least one of the absorbent or transparent layers contains optically variable coloring pigments. For example, the transparent layer 34 can contain liquid crystal pigments showing a reflectance color varying with viewing angle.

Laser irradiation has caused the absorbent layer 36 to be removed in a partial area 40, whereby the transparent layer 38 overlying the absorbent layer 36 was entrained therewith by the ablation. If for example an infrared laser, such as a Nd:YAG laser with $\lambda$=1.064 μm, is used for ablation, the layers 34, 38 transparent to laser radiation can be opaque and colored in the visible spectral range. The form and shape of the removed area 40 permit the coating 32 to be provided with diverse markings, in which for example an optically variable color effect of a liquid crystal layer 34 stands out in contrast with a monochrome surrounding area of a second transparent printed layer 38.

In all these examples the part of the marking produced in the various coatings continues in the surrounding substrate material in the form of a change in color and/or contrast.

The invention claimed is:

1. A value document, comprising a security paper and a marking produced at least in the security paper with the help of a laser, wherein the security paper includes at least one partial area with a coating, wherein the coating comprises a transparent layer being transparent to laser radiation of a selected wavelength and an absorbent layer being absorbent to laser radiation at the selected wavelength and being located between the transparent layer and the security paper, wherein the marking is made by the laser in the coating and extends into the security paper through a border area between the coating and security paper, and the laser influences the coating and the security paper differently such that the appearance of the marking changes in said border area, wherein the marking is shown as a negative representation formed by gaps present only within the coating and extending through the transparent layer and the absorbent layer and is shown as a positive representation in the form of color alterations of the security paper outside the at least one partial area with the coating, wherein the security paper has additives, which change or alter color in the presence of a laser, outside the at least one partial area with the coating to make the positive representation of the marking.

2. The value document according to claim 1, wherein the coating comprises at least one metal layer.

3. The value document according to claim 2, wherein the marking is present in the area of the coating in the form of gaps in the metal layer which run into a color change of the security paper in the border area with the security paper.

4. The value document according to claim 1, wherein the coating comprises at least one plastic layer and one metal layer, the plastic layer having a diffraction structure.

5. The value document according to claim 1, wherein the coating comprises an ink mixture having at least one mixture component absorbent to laser radiation and one mixture component transparent to laser radiation.

6. The value document according to claim 1, wherein the coating is of multilayer design and at least one of the layers includes the marking.

7. The value document according to claim 1, wherein the coating has optically variable properties.

8. The value document according to claim 1, wherein the coating comprises either or both liquid crystalline pigments and interference layer pigments.

9. The value document according to claim 1, wherein the marking is present in a form selected from the group consisting of alphanumeric characters, bar codes, patterns, graphics and microwriting.

10. The value document according to claim 1, wherein a plurality of markings is present on the value document.

11. The value document according to claim 1, wherein the value document is of multilayer configuration.

12. A security paper for value documents, comprising a substrate forming the security paper and having a marking at least in the substrate produced with the help of a laser, wherein the substrate includes a coating in at least one partial area, said coating comprising a transparent layer being transparent to laser radiation of a selected wavelength and an absorbent layer being absorbent to laser radiation at the selected wavelength and being located between the transparent layer and the security paper, wherein the marking is made by the laser in the coating and extends into the substrate through a border area between the coating and substrate, and the laser influences the coating and the security paper differently such that the appearance of the marking changes in said border area, wherein the marking is shown as a negative representation formed by gaps present only within the coating and extending through the transparent layer and the absorbent layer and is shown as a positive representation in the form of color alterations of the security paper outside the at least one partial area having the coating, wherein the security paper has additives, which change or alter color in the presence of a laser, outside the at least one partial area with the coating to make the positive representation of the marking.

13. The security paper according to claim 12, wherein the security paper is of multilayer configuration.

14. A method for producing a marking in a value document including a security paper provided with a coating at least in one partial area, comprising the steps:

exposing the value document to laser radiation, wherein a laser beam is guided over a border area between the coating and the security paper, said coating comprising a transparent layer being transparent to laser radiation of a selected wavelength and an absorbent layer being absorbent to laser radiation at the selected wavelength and being located between the transparent layer and the security paper, removing a partial area of the absorbent layer and entraining the transparent layer by ablation, and selecting laser parameters so as to produce a marking which is present both in the area of the coating and in the area of the security paper and extends over the border area, and the laser radiation influences the coating and the security paper differently such that the appearance of the marking changes in said border area, wherein the marking is shown as a negative representation formed by gaps present only within the coating and extending through the transparent layer and the absorbent layer and is shown as a positive representation in the form of color alterations of the security paper outside the at least one partial area having the coating, wherein the security paper has additives, which change or alter color in the presence of laser radiation, outside the at least one partial area with the coating to make the positive representation of the marking.

15. The method according to claim 14, wherein a Nd:YAG laser is used.

16. A method for producing a marking in a security paper for value documents including at least one partial area having a coating, comprising the steps:

exposing the security paper to laser radiation, wherein a laser beam is guided over a border area between coating and security paper, said coating comprising a transparent layer being transparent to laser radiation of a selected wavelength and an absorbent layer being absorbent to laser radiation at the selected wavelength and being located between the transparent layer and the security paper, removing a partial area of the absorbent layer and entraining the transparent layer by ablation, and selecting laser parameters so as to produce a marking which is present both in the area of the coating and in the area of the security paper, and the marking also extends over the border area, and the laser influences the coating and the security paper differently such that the appearance of the marking changes in said border area, wherein the marking is shown as a negative representation formed by gaps present only within the coating and extending through the transparent layer and the absorbent layer and is shown as a positive representation in the form of color alterations of the security paper outside the at least one partial area having the coating, wherein the security paper has additives, which change or alter color in the presence of laser radiation, outside the at least one partial area with the coating to make the positive representation of the marking.

17. The method according to claim 16, wherein a Nd:YAG laser is used.

* * * * *